US006145839A

United States Patent [19]

Katsion et al.

[11] Patent Number: 6,145,839

[45] Date of Patent: Nov. 14, 2000

[54] MOVIE GAME

[76] Inventors: Marlene Katsion; Christine Thomas, both of 465 W. Dominion Dr., #809, Wood Dale, Ill. 60191

[21] Appl. No.: 09/220,930

[22] Filed: Dec. 24, 1998

[51] Int. Cl.[7] ..... A63F 1/00

[52] U.S. Cl. ..... 273/308; 273/296; 273/432

[58] Field of Search ..... 273/429, 430, 273/431, 292, 296, 148 A, 432, 308

[56] References Cited

U.S. PATENT DOCUMENTS

| | | |
|---|---|---|
| 422,682 | 3/1890 | Young . |
| 1,292,184 | 1/1919 | Wells . |
| 1,381,643 | 6/1921 | Jourdan . |
| 4,666,161 | 5/1987 | Elesie . |
| 5,100,154 | 3/1992 | Mullins . |
| 5,121,928 | 6/1992 | Salern-Sonneberg . |
| 5,193,818 | 3/1993 | Leeson . |
| 5,735,522 | 4/1998 | Sausa . |
| 5,735,544 | 4/1998 | Buckner . |
| 5,743,565 | 4/1998 | Zimmanack . |
| 5,877,842 | 3/1999 | Gibbens . |

*Primary Examiner*—Benjamin H. Layno
*Assistant Examiner*—Vishu Mendiratta

[57] ABSTRACT

A movie game method and apparatus is provided including a score pad having a plurality of sheets of paper and a timer. Also included is a stack of a plurality of playing cards each having a top face, a bottom face, and a periphery formed therebetween. Each of the playing cards of the stack includes a top face with an actor thereon and a bottom face with a list of movies thereon in which the actor appeared.

1 Claim, 1 Drawing Sheet

MOVIE GAME

BACKGROUND OF THE INVENTION

1. Field of the Invention

The present invention relates to board games and more particularly pertains to a new movie game for providing an easily played game.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,066,016; U.S. Pat. No. 5,121,928; U.S. Pat. No. 4,306,725; U.S. Pat. Des. 171,084; U.S. Pat. No. 3,935,651; and U.S. Pat. No. 1,704,721.

In these respects, the movie game according to the present invention substantially departs from the conventional concepts and designs of the prior art, and in so doing provides an apparatus primarily developed for the purpose of providing an easily played game.

SUMMARY OF THE INVENTION

In view of the foregoing disadvantages inherent in the known types of board games now present in the prior art, the present invention provides a new movie game construction wherein the same can be utilized for providing an easily played lame.

The general purpose of the present invention, which will be described subsequently in greater detail, is to provide a new movie game apparatus and method which has many of the advantages of the board games mentioned heretofore and many novel features that result in a new movie game which is not anticipated, rendered obvious, suggested, or even implied by any of the prior art board games, either alone or in any combination thereof.

To attain this, the present invention generally comprises a score pad including a plurality of sheets of paper each with an elongated top edge, an elongated bottom edge and a pair of short edges. The top edges of the sheets are attached via a spine. The score pad further includes a planar rectangular block having a lower side corner being hingably coupled to an end of a top edge of the spine. In use, the block is adapted for pivoting within a plane in which the score pad resides. Next provided is a pencil including an elongated shaft having a first end being sharpened and a second end equipped with an eraser representative of a kernel of popped popcorn. Also included is a timer including an hourglass for indicating the cessation of a predetermined amount of time. FIG. 2 shows a box including a bottom portion including a planar rectangular bottom face and peripheral side wall coupled to a periphery of the bottom face and extending upwardly therefrom. The box further includes a top face with a peripheral side wall coupled to the top face and depending therefrom for removably receiving the side wall of the bottom portion. FIG. 3 depicts a first stack of a plurality of playing cards each having a planar rectangular configuration with a top face, a bottom face, and a periphery formed therebetween. Each of the playing cards of the first stack includes a top face with a name and a pictorial representation of an actor thereon. A bottom face of each playing card is equipped with a list of movies thereon in which the actor appeared. FIG. 4 shows a second stack of a plurality of tie-breaking cards each having a planar rectangular configuration with a top face, a bottom face, and a periphery formed therebetween. Each of the tie-breaking cards of the second stack includes a top face with a name and a pictorial representation of an actor thereon. Unlike the first stack of playing cards, the tie-breaking cards have a bottom face with a list of movies thereon for which the actor received or was nominated for an award.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new movie game apparatus and method which has many of the advantages of the board games mentioned heretofore and many novel features that result in a new movie game which is not anticipated, rendered obvious, suggested, or even implied by any of the prior art board games, either alone or in any combination thereof.

It is another object of the present invention to provide a new movie game which may be easily and efficiently manufactured and marketed.

It is a further object of the present invention to provide a new movie game which is of a durable and reliable construction.

An even further object of the present invention is to provide a new movie game which is susceptible of a low cost of manufacture with regard to both materials and labor, and which accordingly is then susceptible of low prices of sale to the consuming public, thereby making such movie game economically available to the buying public.

Still yet another object of the present invention is to provide a new movie game which provides in the apparatuses and methods of the prior art some of the advantages thereof, while simultaneously overcoming some of the disadvantages normally associated therewith.

Still another object of the present invention is to provide a new movie game for providing an easily played game.

Even still another object of the present invention is to provide a new movie game that includes a score pad having a plurality of sheets of paper and a timer. Also included is a stack of a plurality of playing cards each having a top face, a bottom face, and a periphery formed therebetween. Each of the playing cards of the stack includes a top face with an actor thereon and a bottom face with a list of movies thereon in which the actor appeared.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
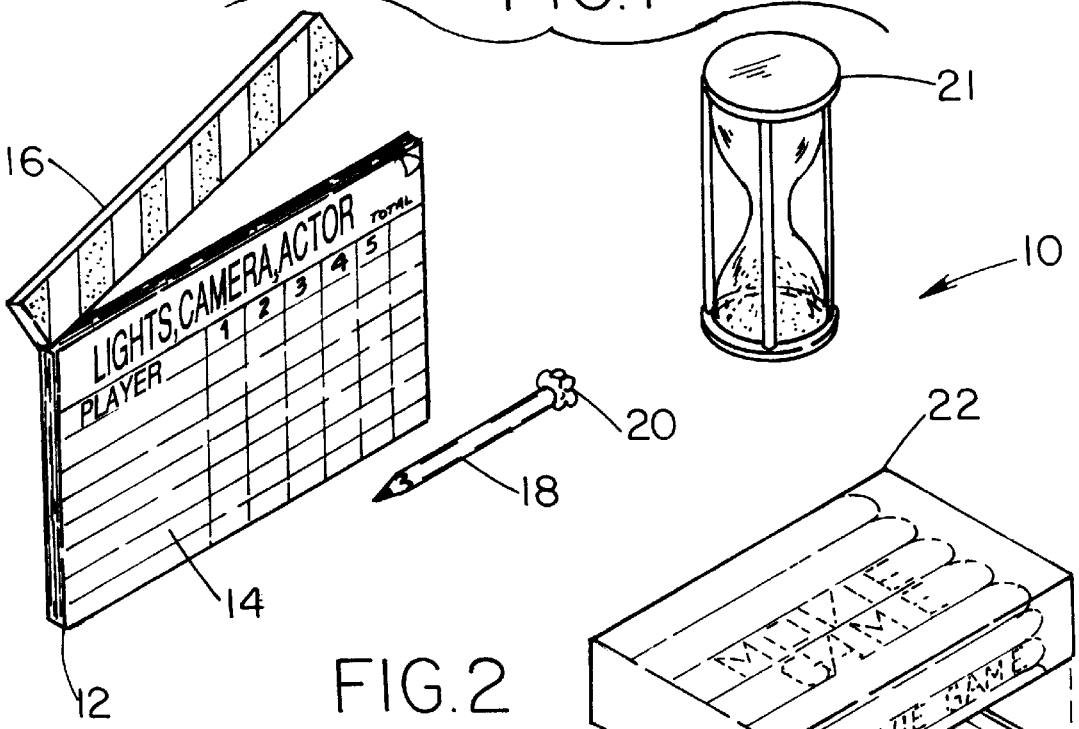
FIG. 1 is an exploded perspective view of a new movie game according to the present invention.

With reference now to the drawings, and in particular to FIGS. 1 through 4 thereof, a new movie game embodying the principles and concepts of the present invention and generally designated by the reference numeral 10 will be described.

The present invention, designated as numeral 10, includes a score pad 12 including a plurality of sheets of paper 14 each with an elongated top edge, an elongated bottom edge and a pair of short edges. Each sheet of paper preferably has a plurality of columns representative of rounds, a plurality of rows unique to a player and a total column. The top edges of the sheets arc attached via a spine. The score pad further includes a planar rectangular block 16 having a lower side corner being hingably coupled to an end of a top edge of the spine. In use, the block is adapted for pivoting within a plane in which the score pad resides.

Next provided is a pencil 18 including an elongated shaft having a first end being sharpened and a second end equipped with an eraser representative of a kernel of popped popcorn 20. Also included is a timer 21 including an hourglass for indicating the cessation of a predetermined amount of time.

Figure 2:
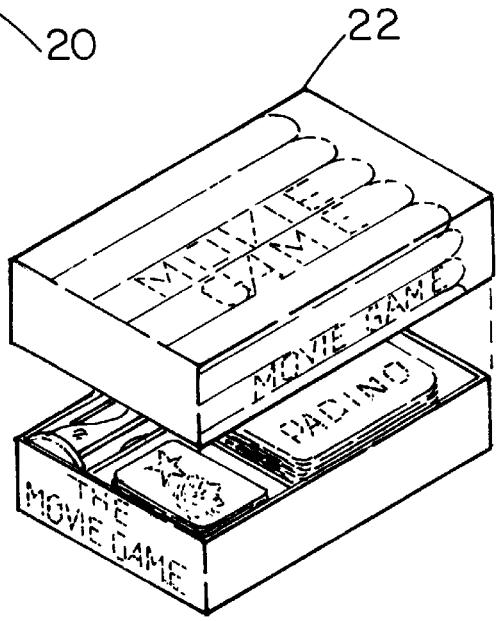
FIG. 2 is a perspective view of the box of the present invention.

FIG. 2 shows a box 22 including a bottom portion having a planar rectangular bottom face and peripheral side wall coupled to a periphery of the bottom face and extending upwardly therefrom. The box further includes a top face with a peripheral side wall coupled to the top face and depending therefrom for removably receiving the side wall of the bottom portion.

Figure 3:
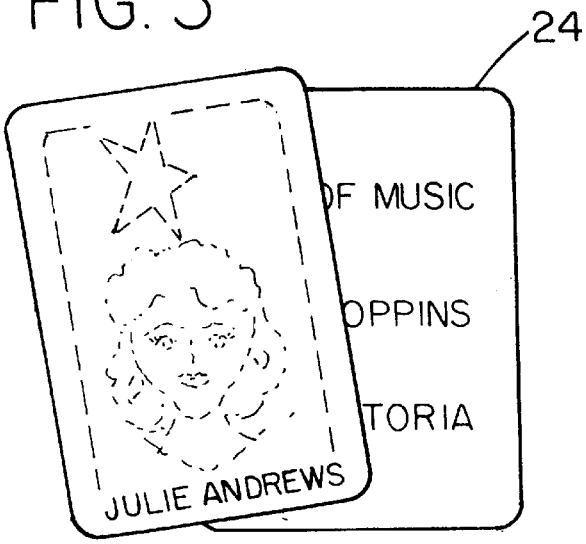
FIG. 3 is an illustration of the playing cards of the first deck of the present invention.

FIG. 3 depicts a first stack of a plurality of 5×7 inch playing cards 24 each having a planar rectangular configuration with a top face, a bottom face, and a periphery formed therebetween. Each of the playing cards of the first stack includes a top face with a name and/or a pictorial representation of an actor thereon. A bottom face of each playing card is equipped with a list of movies thereon in which the actor appeared.

Figure 4:
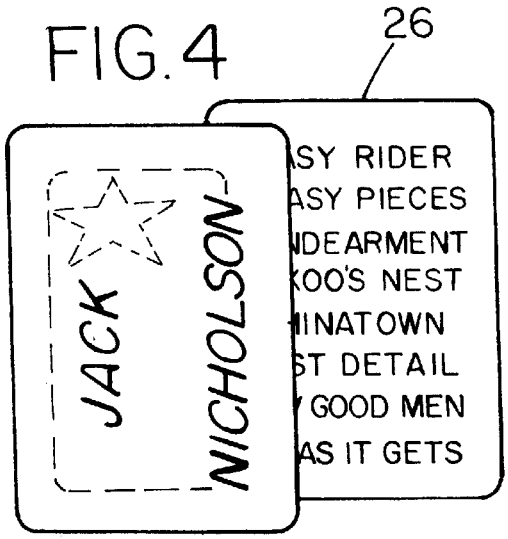
FIG. 4 is an illustration of the tie-breaking cards of the second deck of the present invention.

FIG. 4 shows a second stack of a plurality of 3×5 inch tie-breaking cards 26 each having a planar rectangular configuration with a top face, a bottom face, and a periphery formed therebetween. Each of the tie-breaking cards of the second stack includes a top face with a name and/or a pictorial representation of an actor thereon. Unlike the first stack of playing cards, the tie-breaking cards each has a bottom face with a list of movies thereon for which the actor either received or was nominated for an award. Of course, the actor would have to also have appeared in such movies.

The method associated with the present invention will now be set forth. Before play, a person is designated as a scorekeeper. Further, a person is designated to operate the timer.

During play, a predetermined number of rounds arc played wherein each round includes one of the players picking one of the playing cards from the first stack and identifying verbally the name of the actor on the top face thereof. Thereafter, the players take turns in sequential order. Each of such turns includes the act of attempting to correctly guess a single one of the movies on the bottom face of the picked playing card. It should be noted that a wrong guess renders the current player out while a correct guess affords the current player a point. Further, during the turn, the current player is rendered out if a correct guess is not given before the cessation of the predetermined amount of time after the playing card is picked.

During each round, the players continue to take turns until each of the players is rendered out or each of the movies on the bottom face of the picked playing card are guessed, whichever occurs first. It should be noted that at the beginning of each round, a subsequent or adjacent player picks one of the playing cards prior to the players taking turns in the foregoing manner.

At the end of the round when two players remain, a tie is broken by each of the players simultaneously picking one of the tie-breaking cards from the second stack and simultaneously verbally identifying the name of the actor on the top face of the picked tie-breaking card. Once this is done, the timer is set. In the designated amount of time, the player who correctly guesses the greatest amount of movies on the bottom face of the tie-breaking card picked by the opposing player wins the round. This may constitute winning of the final point or any other compensation deemed fit by the users. The foregoing tie-breaking method may be continued and/or repeated as long as necessary.

After each round, the number of points afforded each player is recorded on the score pad. Further, a winner is declared as being the player who is afforded the most points in the predetermined number of rounds.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A movie game method comprising the steps of:

providing a score pad including a plurality of sheets of paper each with an elongated top edge, an elongated bottom edge and a pair of short edges, the top edges of the sheets being attached via a spine, the score pad further including a planar rectangular block having a lower side corner being hingably coupled to an end of a top edge of the spine for pivoting within a plane in which the score pad resides;

providing a pencil with an elongated shaft having a first end being sharpened and a second end equipped with an eraser representative of a kernel of popped popcorn;

providing a timer including an hourglass for indicating the cessation of a predetermined amount of time;

providing a box including a bottom portion including a planar rectangular bottom face and peripheral side wall coupled to a periphery of the bottom face and extending upwardly therefrom, the box further including a top face with a peripheral side wall coupled to the top face and depending therefrom for removably receiving the side wall of the bottom portion;

providing a first stack of a plurality of playing cards each having a planar rectangular configuration with a top face, a bottom face, and a periphery formed therebetween, each of the playing cards of the first stack including a top face with a name and a pictorial representation of an actor thereon and a bottom face with a list of movies thereon in which the actor appeared;

providing a second stack of a plurality of tie-breaking cards each having a planar rectangular configuration with a top face, a bottom Face, and a periphery formed therebetween, each of the tie-breaking cards of the second stack including a top face with a name and a pictorial representation of an actor thereon and a bottom face with a list of movies thereon for which the actor received or was nominated for an award;

designating a person as a scorekeeper;

designating a person to operate the timer;

playing a predetermined number of rounds, wherein each round includes the steps of:

picking one or the playing cards from the first stack, identifying verbally the name of the actor on the top face of the picked playing card, taking turns between a plurality of players in sequential order, each turn including the act of correctly guessing a single one of the movies on the bottom face of the picked playing card such that a wrong guess renders the current player out and further such that a correct guess affords the current player a point, wherein the current player is rendered out if a correct guess is not given before the cessation of the predetermined amount of time after the playing card is picked, continuing taking turns until each of the players is rendered out or each of the movies on the bottom face of the picked playing card are guessed, and breaking a tie between a pair of players by each of the players simultaneously picking one of the tie-breaking cards from the second stack and identifying verbally the name of the actor on the top face of the picked tie-breaking card whereafter the player who correctly guesses the greatest amount of movies on the bottom face of the tie-breaking card picked by the opposing player wins the round;

recording the number of points afforded each player on the score pad after each round, and declaring a winner as being the player who is afforded the most points in the predetermined number of rounds.

* * * * *